US007247230B2

(12) United States Patent
Mabrouk

(10) Patent No.: US 7,247,230 B2
(45) Date of Patent: Jul. 24, 2007

(54) ELECTROCHEMICAL SYNTHESIS AND PROCESSING OF CONDUCTING POLYMERS IN SUPERCRITICAL MEDIA

(75) Inventor: Patricia Ann Mabrouk, Boston, MA (US)

(73) Assignee: Northeastern University, Boston, MA (US)

( * ) Notice: Subject to any disclaimer, the term of this patent is extended or adjusted under 35 U.S.C. 154(b) by 653 days.

(21) Appl. No.: 10/638,257

(22) Filed: Aug. 8, 2003

(65) Prior Publication Data

US 2005/0029117 A1 Feb. 10, 2005

(51) Int. Cl.
*C25B 1/00* (2006.01)
*C25B 3/00* (2006.01)

(52) U.S. Cl. ..... 205/338; 205/414

(58) Field of Classification Search ..... 205/338, 205/414

See application file for complete search history.

(56) References Cited

U.S. PATENT DOCUMENTS 3,522,228 A 7/1970 Fukui et al. ..... 260/94.9
3,574,072 A 4/1971 Louvar ..... 204/72
4,769,115 A 9/1988 Satoh et al. ..... 204/59 R
5,855,819 A 1/1999 DeSimone et al. ..... 252/511
5,980,723 A 11/1999 Runge-Marchese et al. 205/316

OTHER PUBLICATIONS

Anderson et al., "Electrochemical Synthesis and Characterization of Conducting Polymers in Supercritical Carbon Dioxide", J. Am. Chem. Soc. (no month, 2002), vol. 124, pp. 10284-10285.*

* cited by examiner

*Primary Examiner*—Edna Wong
(74) *Attorney, Agent, or Firm*—Weingarten, Schurgin, Gagnebin & Lebovici LLP

(57) ABSTRACT

The present invention deals with the electrochemical synthesis of electrically conductive polymers in supercritical fluids, for example supercritical $CO_2$. The use of the supercritical fluid as a solvent results in the reduction or elimination of hazardous reagents and environmentally hazardous waste, which was generated in the prior chemical synthesis techniques. The electrochemical approach eliminates the need to add a charge transfer agent as the electrode serves this purpose. The resulting polymers are characterized by high conductivities and distinctive surface morphology, which suggests that they may be more appropriate than the previous materials for certain applications (e.g., corrosion inhibition, optical applications, etc.).

10 Claims, 6 Drawing Sheets

Figure 6

Compilation of characterization data for PPy / ITO films synthesized in sc $CO_2$, acetonitrile, and aqueous solutions.

| | **Solvent Thickness (μm)** | **Conductivity (S / cm)** | **Morphology** | **UV-vis λ max (nm)** |
|---|---|---|---|---|
| sc $CO_2$ | 0.5 | 4.4 ± 2.0 | flat, nodular | 422 |
| Aceto-nitrile | 6 | 16.3 ± 0.1 | wrinkled | 428 |
| Aqueous | 6 | 2.8 ± 1.2 | cauliflower | 438 |

ELECTROCHEMICAL SYNTHESIS AND PROCESSING OF CONDUCTING POLYMERS IN SUPERCRITICAL MEDIA

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

Conducting polymers (also referred to as conductive polymers) have recently become more important because of their use in, for example, electrochemical devices, chemical and optical sensors, and light emitting devices.

In the past, conductive polymers were traditionally synthesized by either chemical or electrochemical oxidation. The former is accomplished through the use of a charge transfer agent while the latter does not. Both processes can be carried out in aqueous and nonaqueous media, which incorporate hazardous and potentially environmentally damaging materials (e.g., sulfuric acid or acetonitrile).

Recently, DeSimone demonstrated that chemical oxidation can be carried out in supercritical fluids (U.S. Pat. No. 5,855,819). However, their method required the use of charge transfer agents and produced conductive polymers that exhibited poor electrical conductivity (ca. $10^{-5}$ S/cm). During the same time period, several researchers demonstrated that direct electrochemical oxidation and reduction of small molecules was possible in supercritical solvents. (Abbott, A. P.; Harper, J. C. *J. Chem. Soc., Faraday Trans.* 1996, 92, 3895–3898. Olsen, S. A.; Tallman, D. E. *Anal. Chem.* 1994, 66, 503–509. Olsen, S. A.; Tallman, D. E. *Anal. Chem.* 1996, 68, 2054–2061. Niehaus, D. E.; Wightman, R. M.; Flowers, P. A. *Anal. Chem.* 1991, 63, 1728–1732. Niehaus, D.; Philips, M.; Michael, A.; Wightman, R. M. *J. Phys. Chem.* 1989, 93, 6232–6236. Cabrera, C. R.; Bard, A. J. J. *Electroanal. Chem.* 1989, 273, 147–160. Sullenberger, E. F.; Michael, A. C. *Anal. Chem.* 1993, 65, 2304–2310. Dressman, S. F.; Michael, A. C. *Anal. Chem.* 1995, 67, 1339–1345.)

Until the development described herein, there had been no synthesis of conducting polymers utilizing solely safe components.

Furthermore, the morphology of conducting polymers synthesized in the past was such that it limited its utility, for those applications which are impacted by morphology, e.g., corrosion inhibition and dielectrics.

BRIEF SUMMARY OF THE INVENTION

The present invention deals with the electrochemical synthesis of electrically conductive polymers in supercritical fluids, for example $CO_2$. The use of the supercritical fluid as a solvent results in the reduction or elimination of hazardous reagents and environmentally hazardous waste, which was generated in the prior chemical synthesis techniques, eliminates the need for separation and disposal of the charge transfer agent, and prevents exposure of the polymer to harsh acids and organic solvents that can degrade the conductive polymer. The novel technique is accomplished in a cell that can withstand the pressures and temperatures required to produce the supercritical fluids (ca. 31° C. and 70 atm for carbon dioxide). The resulting polymers are characterized by high conductivities superior to those produced by DeSimone and comparable to those produced electrochemically in aqueous and nonaqueous media. In addition, the polymer films produced by our method are thin, dense, and relatively featureless—characteristics that may advantageous for certain applications (e.g., corrosion inhibition and dielectrics).

BRIEF DESCRIPTION OF THE FIGURES

FIG. 6 shows the characterization data for polypyrrole films synthesized at an indium tin oxide electrode in various solvents.

DETAILED DESCRIPTION OF THE INVENTION

Figure 1:
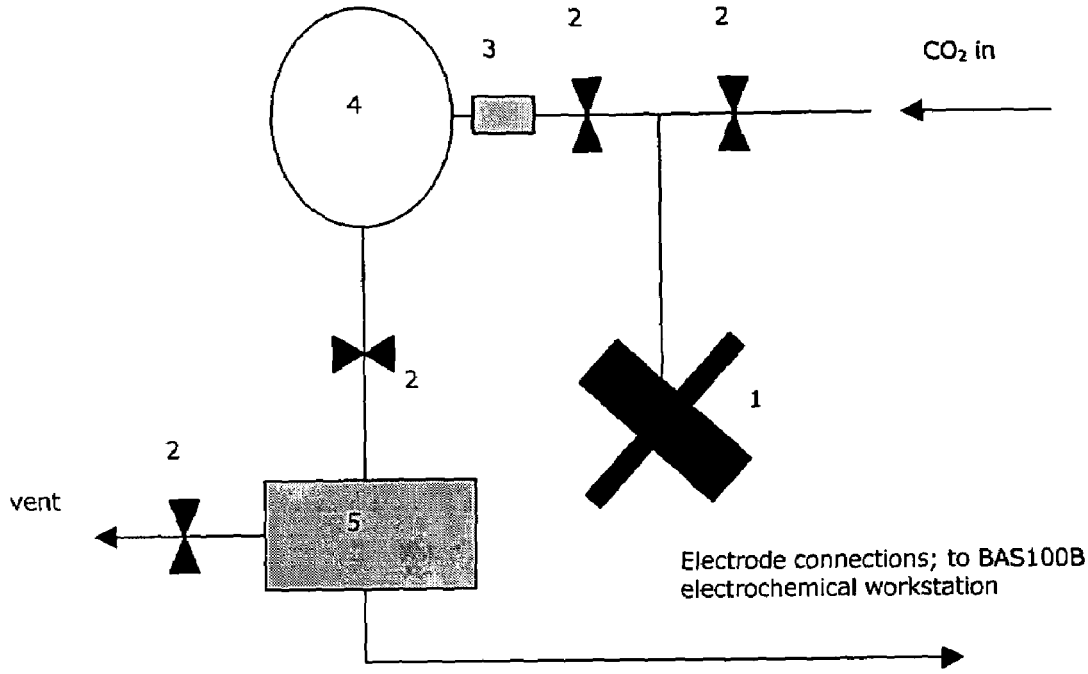
FIG. 1 shows a schematic of the equipment for synthesis of a conducting polymer.
Figure 2:
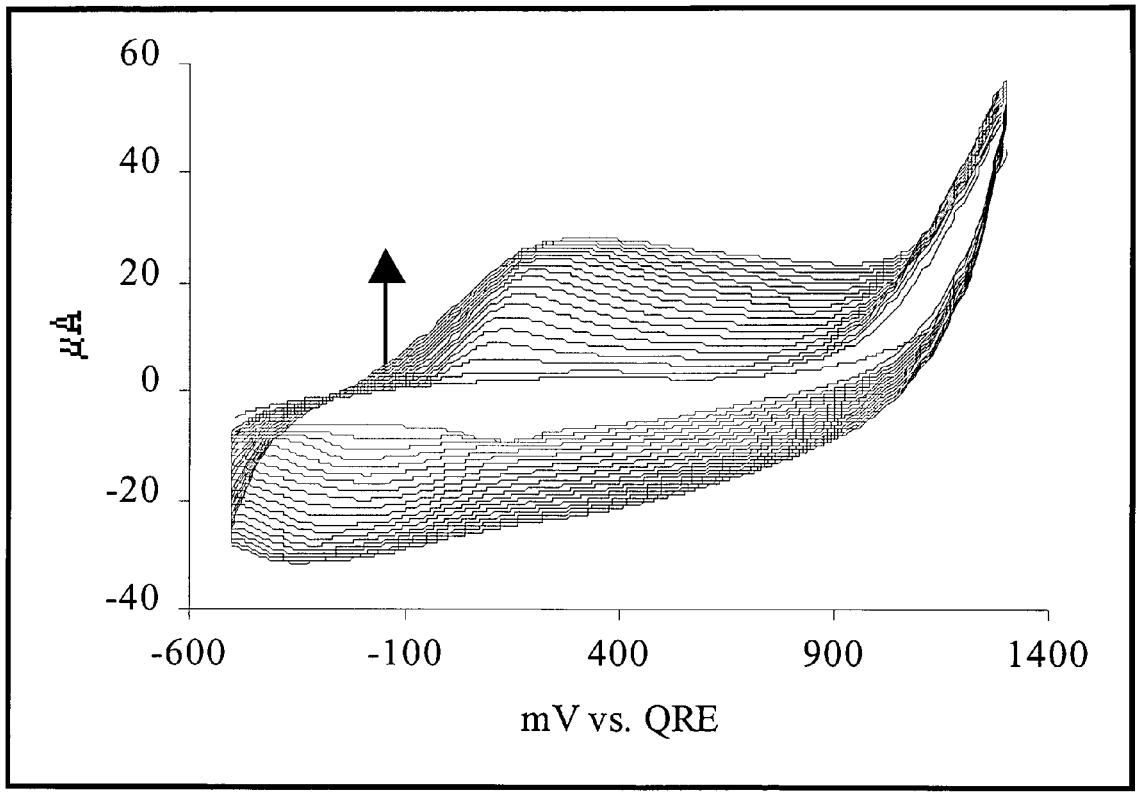
FIG. 2 shows the electropolymerization of pyrrole by cyclic voltammetry at an indium tin oxide electrode in supercritical $CO_2$ containing 0.16 M n-tetrabutylammonium hexafluorophosphate and 13.1 vol % acetonitrile.

Conducting polymers, for example polypyrrole (also referred to herein as PPy) and polyaniline (also referred to herein as PAn), have received much attention for their use as corrosion inhibitors, free-standing conductive membranes and components in microelectronic devices. (Angelopoulos, M. IBM J. Res. & Dev. 2001, 45, 57–75. Wessling, B. Adv. Mater. 1994, 6, 226–228. Oyama, N.; Tatsuma, T.; Sato, T.; Sotomura, T. Nature 1995, 373, 598–600.)

Examples of suitable monomers that can be used to form conducting polymers include methylpyrrole, 2,2'-bithiophene, 3-n-butylthiophene, furan, thiophene, selenophene, thieno[2,3-b]thiophene, thieno-3,2-b]pyrrole, isothianaphlene, fluorene, carbazole, dibenzothiophene, dithieno[3,2-b:2',3'-d]thiophene, cyclopenta[2,1-b:3'4'-b]dithiophen-4-one, n-hexylpyrrole, and acetylene; vinylenephenylene pyrrole, aniline, and 3-alkylthiophene.

Supercritical (also referred to as sc herein) fluids are those liquids, which are formed by the application of temperature and pressure to gases. These fluids are unique, since they have characteristics different from both the liquid and gaseous phases of the given fluid. Aside from carbon dioxide, other supercritical fluids are usable in the instant process, for example ammonia, fluoroform, chlorodifluoromethane, and mixtures thereof.

In the past, synthesis of conducting polymers utilized chemical polymerization. I.e., it was necessary to include charge transfer agents, such as $Fe(ClO_4)_3$, $KIO_3$, or $K_2Cr_2O_7$, which, when added to the system, oxidized the monomer and resulted in polymerization. No charge transfer agents are needed in the instant process, as the electrode itself functions as the charge transfer agent when an anodic potential is applied the monomer is oxidized.

The only electrochemistry conducted to date in supercritical fluids has been limited to the study of simple reversible redox systems such as ferrocene, due to the limited solubility of many solutes and electrolytes, the poor conductivity of supercritical carbon dioxide and poor electrode kinetics in supercritical fluids. However, this is much different from the electrochemical polymerization conducted herein.

The present method has several advantages over the methods that have heretofore been developed. The present method does not require the use of charge transfer agents, can be carried out in environmentally friendly supercritical solvents such as carbon dioxide that do not degrade the quality of the polymer and produces conductive polymers with conductivity (ca. 10 S/cm) that rivals that of the established methods.

Electrolytes and cosolvents can also be added to the polymerization mixture. (The term electrolyte when used herein will also include materials that could potentially be used as cosolvents.) The electrolyte used in this invention can contain any of the standard electrolyte anions such as perchlorate, tetrafluoroborate, hexafluorophosphate, tetraphenylborate, etc. that are used as electrolytes in other electrochemical processes. The electrolyte cations should facilitate the dissolution of the electrolyte in a supercritical fluid. Possible cations might include quaternary ammonium cations such as tetrabutylammonium, tetrahexylammonium, and tetrakis(decyl)ammonium. While there are no restrictions on the concentration of the electrolyte used, the higher the concentration the better. A concentration of 0.1 M or better is preferred. Cosolvents or modifiers increase the solubility of the monomer and include such reagents as acetonitrile, methanol, and dimethyl sulfoxide. Some reagents perform the function of both electrolyte and cosolvent, for example ionic liquids such as tetrabutylammoniumhexafluorophosphate.

Modifiers may not be absolutely necessary for the invention nor is there any particular restriction on their concentration. However, they increase the solubility of the supercritical carbon dioxide and allow more monomer to be dissolved hence more polymer produced. Hence the higher the concentration of the modifier the better. The particular concentration that can be used depends on the specific modifier. Modifiers include those solvents that are miscible in some proportion with the supercritical solvent and which increase the polarity of the supercritical solvent. Examples of suitable modifiers for use in supercritical carbon dioxide include acetonitrile, methanol, and dimethyl sulfoxide.

Equipment a. One component that is required is an electrode, which can serve as the oxidizing agent or electron sink in the polymerization. There is reference herein mainly to an indium tin oxide electrode, but other electrodes can also be used (e.g., gold, platinum, etc.). There is no restriction on the materials that can be used for the electrode, and any of the usual inorganic or organic electroconductive materials may be used. These electrodes can be obtained commercially (e.g., from Bioanalytical Systems) or made in the laboratory.

b. An electrochemical cell suitable for use with supercritical fluids is needed. Often this is a high pressure cell, one that can safely withstand the pressure and temperature applied. Typically the pressures applied will range from about 1400 to 1800 psi at temperatures between 35 to 45° C. in $scCO_2$. For work with supercritical carbon dioxide stainless steel cells are used. These cells can be obtained commercially from companies such as Thar Technologies, Inc. (Pittsburgh, Pa.) or can be machined in house or by companies such as High Pressure Equipment Co. Inc. (Erie, Pa.)

c. An example of apparatus that can be used for conducting the polymerization is shown in FIG. 1. 1 represents a pressure generator (e.g., Model 62-6-10 from High-Pressure Equipment Co.). 2 represents valves (e.g., the Nupro SS-DLS4 valve). 3 is a flow check valve. 4 is an analog pressure gauge from Heiss (0–4000 psi, subdivisions 10). 5 is a custom made electrochemical cell, 4.5 $cm^3$ internal volume (e.g., from High Pressure Equipment Co.).

Process

The process described herein is an environmentally benign, relatively safe, inexpensive method of synthesizing conducting polymers. The polymerization takes place in near-critical or supercritical solvents at relatively low temperature and pressure.

For example, aniline or aniline hydrochloride is electrochemically oxidized in the presence of electrolyte and a variable amount of a polar modifier, a supercritical fluid-miscible solvent such as acetonitrile that is also usually fairly volatile at room temperature and atmospheric pressure, at a solid electrode in supercritical media by continuous cycling of a metal or semiconductor working electrode between potentials at which the monomer can be oxidized and reduced. The polar modifier itself does not directly participate in the electrochemical process but serves to increase the solubility of the monomer and electrolyte and to increase the conductivity of the supercritical fluid medium. Presumably when the cell is vented, the small amount of the modifier is volatilized and vented. The process does not use a chemical charge transfer agent.

The process involves adjusting temperature and pressure to conditions that will result in near-critical or supercritical conditions. For example, for $CO_2$, the pressure and temperature can be increased until the critical or supercritical condition is reached. When these conditions are achieved, electrochemical polymerization can take place, for example by cycling the applied potential between oxidizing and reducing potential limits for the monomer.

A variety of different electrochemical methods can be used to prepare these polymers. The above description of cyclic voltammetry, in which the potential of the working electrode is cyclically varied between oxidizing and reducing potential limits, is only one technique. Potentially stepping the potential of the working electrode to oxidizing potentials, or other electrochemical excitation techniques, could also be used.

Techniques for Characterizing Polymer

Various techniques have been utilized to characterize the resulting conducting polymer, including conductivity measurements, profilometry, UV-visible spectrometry, Raman spectroscopy, and scanning electron microscopy. These techniques are described in more detail in the examples below.

Benefits

It has been found that the method described herein is an alternative to the previously known methods for synthesizing conductive polymers. As shown in FIG. 6, the conductivities of the polymers synthesized using the novel technique are comparable to those found in polymers synthesized using the former methods.

However, different physical and chemical properties may result. For example, the morphology of the polymer synthesized using the new method is different. As mentioned earlier this may be advantageous in realizing certain applications of conductive polymers such as optical, dielectric and anticorrosion applications. For example, the polypyrrole polymer films generated in supercritical $CO_2$ were smoother and flatter and can be characterized as having a globular or nodular appearance. (See FIG. 5)

The following examples are intended to illustrate, not limit, the scope of the invention.

EXAMPLES

Example 1

Electrochemical Synthesis of Conducting Polymer in Supercritical $CO_2$ a. Starting Materials Pyrrole (Aldrich, analytical grade) was vacuum distilled, stored in a dark hood, and degassed with nitrogen for approximately 20 minutes before use. Aniline hydrochloride (Fluka, 99%), tetrabutylammonium hexafluorophosphate (TBAPF6; Aldrich, 98%), carbon dioxide (Scott Specialty Gases; supercritical fluid grade), and acetonitrile (Fisher; HPLC grade) were all used as received.

Single side coated indium tin oxide on glass (ITO) electrodes were fabricated by cutting ITO glass slides (Delta Technologies, Inc., Rs=4–8 Ω., part #401N-1111) into 2 mm×5 mm rectangles, wrapping one end of the electrode with copper wire, and establishing electrical contact between the ITO and copper with silver paint (Ernest Fullam). Upon drying, the ITO/copper wire assembly was placed in a nylon tube, which was subsequently bonded and sealed into a ¼" stainless steel tube using two-part epoxy (Epoxi-Patch; Dexter). The ITO surface was cleaned by sonication in Alconox® solution (1 g/10 mL) for 10 minutes, rinsed with deionized water, and sonicated a second time in deionized water for 10 minutes. The surface was gently cleaned with a methanol soaked cotton swab and finally rinsed with deionized water. Electrodes were then tested in a 1 mM solution of potassium ferricyanide/1 M potassium nitrate. $\Delta E_p$ values were typically 70–90 mV at 100 mV/s.

b. Electrochemical Polymerization Supercritical fluid electrochemical synthesis was performed using a one-compartment high pressure stainless steel electrochemical cell. When attached to the supercritical fluid delivery system shown in FIG. 1, the internal cell volume was ≅4.5 $cm^3$. The ITO electrode was used as the working electrode, while the cell was used as both the counter and quasireference electrode (QRE). $TBAPF_6$ ($7.2\times10^{-4}$ moles) was used as the electrolyte and dissolved in a minimal amount ($1.1\times10^{-2}$ moles) of acetonitrile, which was added to the cell with pyrrole ($7.2\times10^{-4}$ moles) or aniline hydrochloride ($7.2\times10^{4}$ moles).

The working electrode was mounted in the cell and the cell was wrapped thoroughly with electrically isolated, insulated electrical heating tape (Thermolyne). The supercritical fluid cell was sealed and the system (see FIG. 1) was pressurized to 200 psi and vented three times. Care was taken to ensure that the reactants were not expelled. The pressure was then raised to the desired set point, and the system was heated. The temperature was monitored by an internal thermocouple (Omega K-type). The cell was intermittently agitated to ensure proper mixing of reagents.

As was found for the aqueous and nonaqueous electrochemical synthesis of these polymers, it was necessary to increase the electrode potential window upon successive cycles. For PPy, the electrode potential limits were −500 and 1100 mV vs. QRE at 100 mV/s. As polymerization ensued, the observed peak currents increased more slowly. Therefore, after approximately 100 cycles, the potential limits were increased to potentials at which the monomer can be oxidized and reduced (e.g., −600 and 1300 mV at 100 mV/s), and electropolymerization was allowed to continue. For PAn synthesis, potential limits of −300 and 900 mV at 100 mV/s were used. For both Ppy and PAn, electropolymerization was continued until an increase in the peak currents in the voltammogram was no longer observed. The cell was cooled to 300° C. (critical temperature for $CO_2$=31.1° C.) and then the system was carefully and slowly vented. The working electrode was removed from the cell and immediately rinsed with acetone, methanol, and deionized water. The coated electrode was stored in air.

Example 2

Analyses/characterization Techniques a. Four-point Probe Conductivity.

Profilometry (Tencor 10) was used to determine the film thickness on the ITO electrode. The film was then lifted from the surface of the electrode by double-sided Scotch tape. A Lucas-Signatone (Model S-301-4) four-point probe was used for conductivity measurements. The dual method in which the current is passed through two different pairs of pins, was used for making each measurement (ASTM Method F 1529-97). The conductivity value reported in this work is the average from at least two different PPy films.

Figure 3:
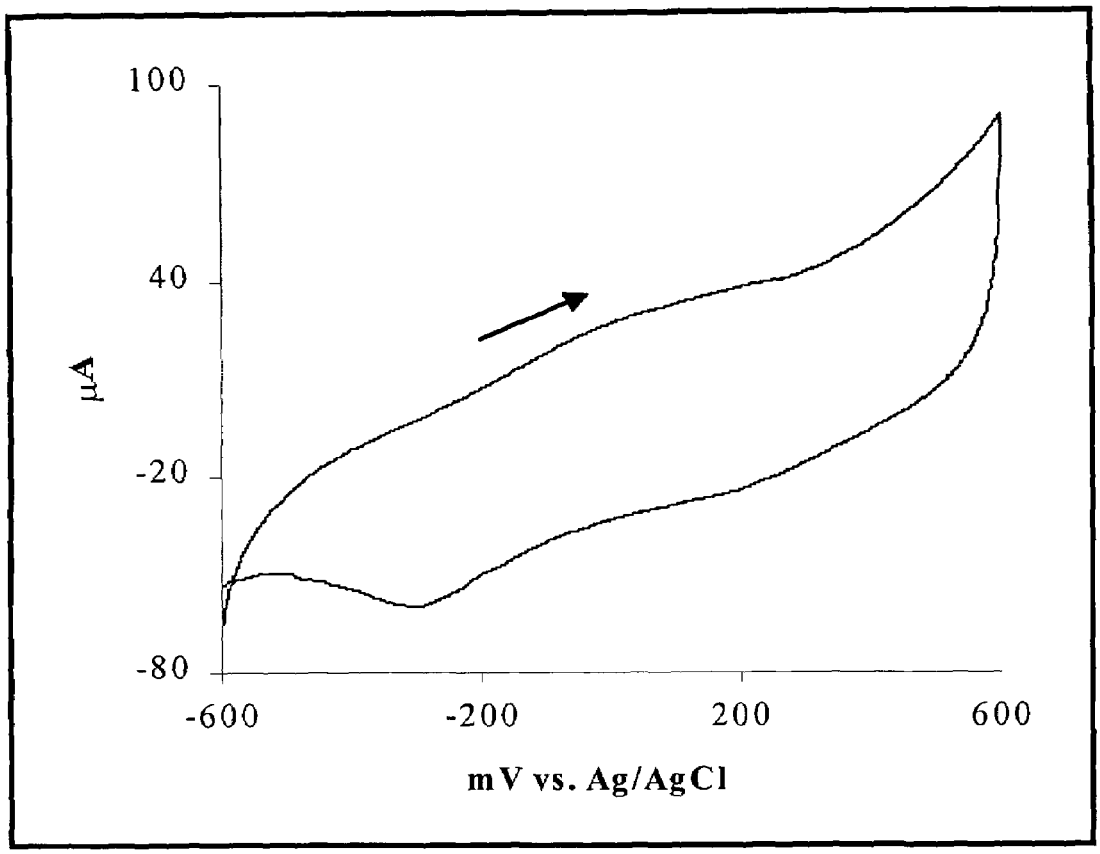
FIG. 3 shows cyclic voltammetry of supercritical $CO_2$ synthesized polypyrrole at an indium tin oxide electrode in 1 M sulfuric acid.
Figure 4:
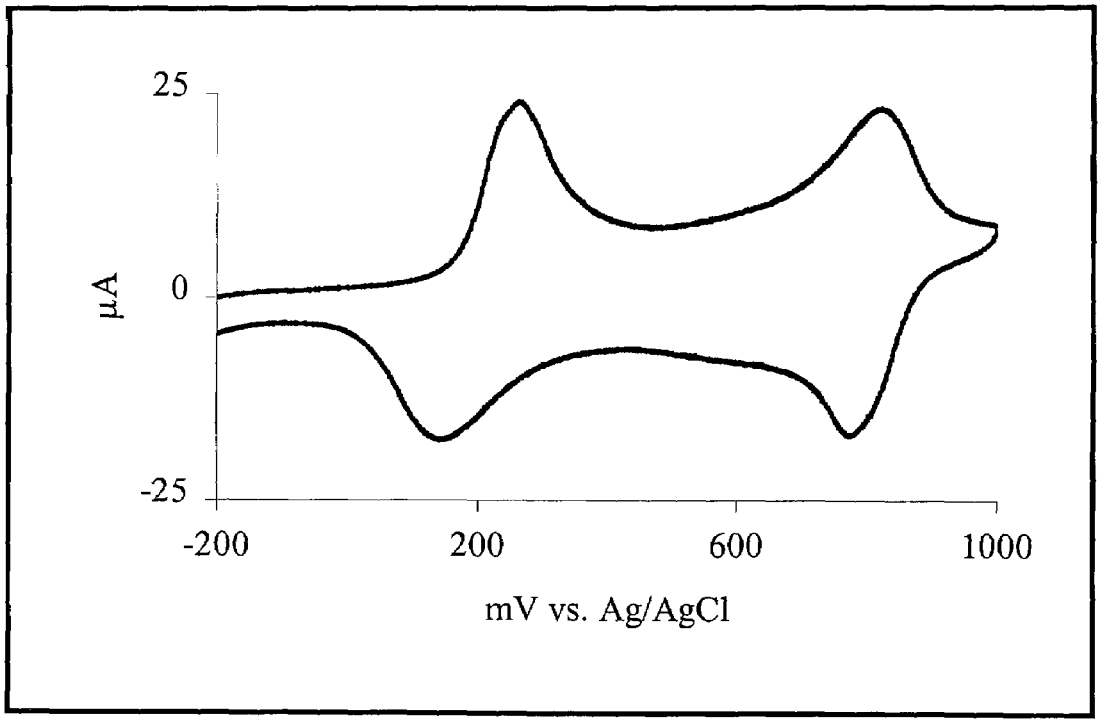
FIG. 4 shows cyclic voltammetry of supercritical $CO_2$ synthesized polyaniline at an indium tin oxide electrode in 1 M hydrochloric acid containing 1 M sodium chloride.

FIG. 3 shows a representative CV for the electro-polymerization of 0.16 M pyrrole in sc $CO_2$ at 100 mV/s. FIG. 4 shows the voltammogram obtained after the PPy-coated ITO electrode was removed from cell, rinsed with acetone, methanol, and deionized water, and placed in a 1 M $H_2SO_4$ solution.

The average film thickness used in this calculation was evaluated over a distance of 500 μm by profilometry. A conductivity of 4.4±2.0 S/cm (n=16) was measured for the sc $CO_2$ synthesized PPy films. As shown in FIG. 6, the conductivity of PPy films synthesized in sc $CO_2$ is comparable to that of PPy synthesized in aqueous and non-aqueous solution. Note that the conductivity found herein is about 5 orders of magnitude higher than that found using the technique of DeSimone.

b. UV-vis Spectroscopy.

A Hewlett-Packard 8452A diode-array UV-vis spectrophotometer was used for all measurements. The optically transparent electrode was positioned perpendicular to theoretical path of the deuterium lamp. The spectra were recorded for the dry electrode in air.

Further analysis of Ppy/ITO films synthesized in sc $CO_2$ using UV-vis spectrometry showed the characteristic broad polaron band at approximately 430 nm. As shown in FIG. 6, the wavelength maximum appears to be sensitive to the polarity of the solvent used in the electrochemical synthesis. The solvating power of sc $CO_2$ is comparable to that of alkanes. The wavelength maximum blue shifts as the polarity of the solvent decreases. This suggests that the solvent plays an important role in determining the structure of PPy.

c. Scanning Electron Microscopy (SEM).

All microscopy was performed on a JEOL 6320FV scanning electron microscope. Accelerating voltage and working distance varied between samples because of the sensitivity of the films to charging. The electrodes were separated from the epoxy-electrode body and bonded to a conductive carbon tape with silver paint.

Figure 5:
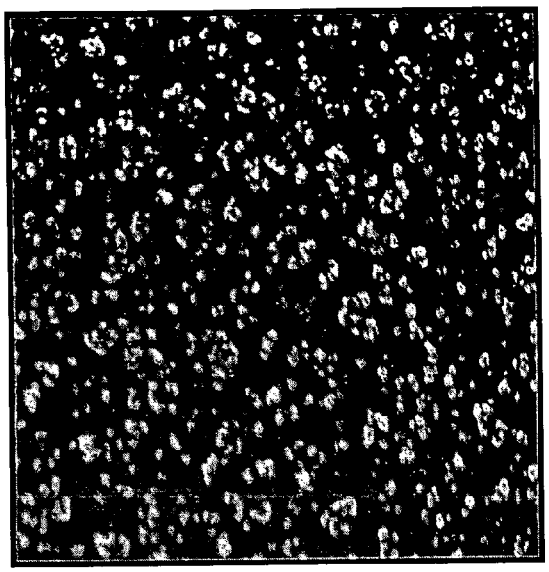
FIG. 5 shows a scanning electron micrograph of (a) polypyrrole grown on indium tin oxide in supercritical $CO_2$ using experimental conditions of FIG. 2 (having a flat, nodular or globular morphology), (b) polypyrrole (having a wrinkled morphology) grown in acetonitrile containing 0.1 M pyrrole and 1 M n-tetrabutylammonium hexafluorophosphate, and (c) polypyrrole grown in 0.1 M HCl (having a cauliflower morphology).
Figure 5:
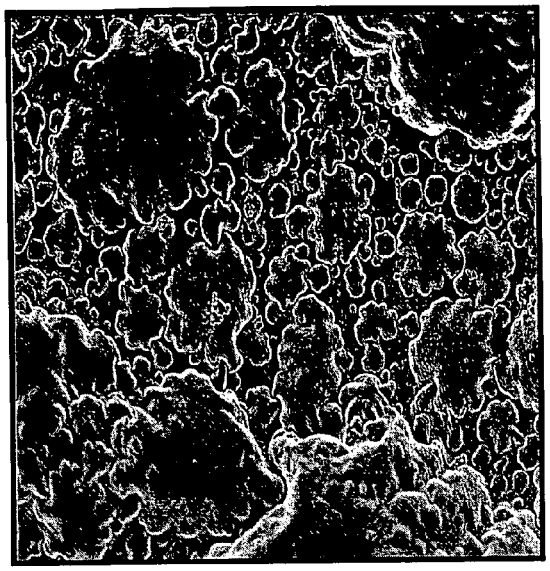
Figure 5:
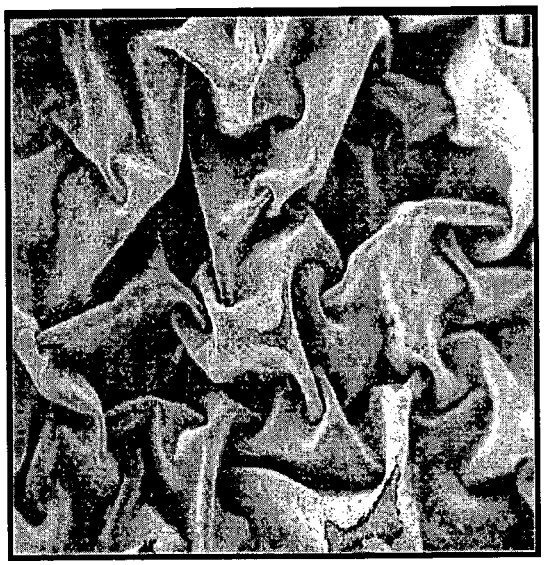

FIG. 5 shows scanning electron micrographs (JEOL JSM 3220) for PPy/ITO films synthesized in sc $CO_2$ and acetonitrile. The sc $CO_2$-synthesized PPy exhibits a markedly different surface morphology consisting of small, raised granular PPy nodules (0.5–3.0 μm) on a flat, continuous PPy surface (0.167±0.08 μm, average thickness, n=10). This is in contrast to the characteristic wrinkled texture of PPy typically observed in films synthesized in nonaqueous solutions. It should be noted that the morphology found herein is different from that found when using other polymerization techniques, including either (a) different polymerization methodologies (e.g., chemical polymerization) or (b) different solvents for conducting electrochemical polymerization (e.g., aqueous or organic solvents). The morphological characteristics exhibited by PPy synthesized in supercritical fluids may be advantageous in anti-corrosion, dielectric, and optical applications.

d. Raman Spectroscopy

PPy films synthesized in non-aqueous solution were examined using a LEICA DMLP Micro-Raman instrument, which revealed polymer regions raised from the ITO surface with air pockets under the film. This made the film appear to have thicker and/or uneven areas of growth, and may have attributed to the brittle nature of the non-aqueous films. A very thin PPy layer was also observed underneath the thicker, raised layer of PPy, which may be more adherent to the ITO surface.

Some aspects of this invention have been discussed in Anderson, P.; Badlani, R.; Mayer, J.; Mabrouk, P. A. J. Amer. Chem. Soc., 2002, 124, 10284–10285. "Electrochemical Synthesis and Characterization of Conducting Polymers in Supercritical Carbon Dioxide." and in Badlani, R.; Mayer, J.; Anderson, P.; Mabrouk, P. A., Polymer Prepr., 2002, 43, 938–939, (both of which are incorporated by reference in their entirety herein) and "Electrochemical Synthesis and Characterization of Conducting Polypyrrole Films in Supercritical Carbon Dioxide," which is available at URL pubs.acs.org/meetingpreprints/poly/meet224/587-538016.pdf).

Further variations of the invention will be recognized to be within the scope of the invention by those with expertise in this technology.

What is claimed is:

1. A process for synthesizing a conducting polymer, said process comprising:

a. delivering into an electrochemical cell suitable for use with supercritical fluids
   1. the monomer used to prepare said polymer,
   2. electrolyte and
   3. a supercritical fluid medium, b. adjusting temperature and pressure to near-critical or supercritical conditions, and c. oxidizing and polymerizing the contents of said cell electrochemically.

2. The process of claim 1 wherein said process further comprises delivering a cosolvent to said electrochemical cell.

3. The process of claim 1 wherein said adjusting temperature and pressure comprises increasing said temperature and pressure.

4. The process of claim 1 wherein said oxidizing and polymerizing comprises cycling applied potential of said cell between oxidizing and reducing potential limits for said monomer.

5. The process of claim 1 wherein said supercritical fluid medium is selected from the group consisting of carbon dioxide, ammonia, fluoroform, chlorodifluoromethane, and mixtures thereof.

6. The process of claim 5 wherein said supercritical fluid medium is carbon dioxide.

7. The process of claim 5 wherein, when the supercritical fluid medium is carbon dioxide, said cell is heated and pressurized at conditions near or above the critical point.

8. The process of claim 1 wherein said monomer is selected from the group consisting of pyrrole, aniline and thiophene.

9. A process for synthesizing a conducting polymer in supercritical carbon dioxide, said process comprising:

a. delivering into an electrochemical cell suitable for use with supercritical fluids
   1. the monomer used to prepare said polymer,
   2. electrolyte and
   3. supercritical carbon dioxide, b. increasing temperature and pressure to near-critical or supercritical conditions for carbon dioxide, and c. oxidizing and polymerizing the contents of said cell electrochemically by cycling applied potential between oxidizing and reducing potential limits for said monomer.

10. The process of claim 9 wherein said process further includes delivering a cosolvent to said electrochemical cell.

* * * * *